US007874437B2

(12) United States Patent
Jones

(10) Patent No.: US 7,874,437 B2
(45) Date of Patent: Jan. 25, 2011

(54) MECHANICAL CLOSET

(76) Inventor: Dean Adare Jones, 16065 Falconcrest Dr., San Diego, CA (US) 92127

( * ) Notice: Subject to any disclaimer, the term of this patent is extended or adjusted under 35 U.S.C. 154(b) by 220 days.

(21) Appl. No.: 12/206,920

(22) Filed: Sep. 9, 2008

(65) Prior Publication Data

US 2010/0059462 A1 Mar. 11, 2010

(51) Int. Cl.
*A47F 7/00* (2006.01)

(52) U.S. Cl. ..... 211/85.3; 211/26; 211/96; 211/105.1; 312/319.6

(58) Field of Classification Search ..... 211/85.3, 211/26, 96, 105.1; 312/319.6, 248, 325, 312/319.5

See application file for complete search history.

(56) References Cited

U.S. PATENT DOCUMENTS

| | | | | |
|---|---|---|---|---|
| 2,433,275 | A | 2/1946 | Higby | |
| 2,473,239 | A * | 6/1949 | Boyd | 312/319.3 |
| 2,875,903 | A * | 3/1959 | Shourds | 211/100 |
| 2,919,966 | A * | 1/1960 | Preston | 312/27 |
| 3,417,874 | A * | 12/1968 | Bryant | 211/100 |
| 4,111,309 | A | 9/1978 | Henry | |
| 4,134,629 | A * | 1/1979 | Hansen | 312/246 |
| 4,252,242 | A * | 2/1981 | Tudor | 211/96 |
| 4,485,928 | A | 12/1984 | Staashelm | |
| 4,760,926 | A | 8/1988 | Iuni | |
| 4,886,172 | A | 12/1989 | Kummerlen | |
| 4,915,461 | A * | 4/1990 | Kingsborough et al. | 312/247 |
| 5,249,858 | A * | 10/1993 | Nusser | 312/319.6 |
| 5,456,529 | A * | 10/1995 | Cheung | 312/245 |
| 5,535,896 | A | 7/1996 | Morgan | |
| 5,560,501 | A | 10/1996 | Rupert | |
| 5,758,782 | A | 6/1998 | Rupert | |
| 6,065,618 | A | 5/2000 | Stetler | |
| 6,196,398 | B1 | 3/2001 | Lowe | |
| 7,246,865 | B1 * | 7/2007 | Merrell, II | 312/248 |

* cited by examiner

*Primary Examiner*—Korie Chan
(74) *Attorney, Agent, or Firm*—Harry V. McGahey, Jr.; McGahey & McGahey, APLC

(57) ABSTRACT

A Mechanical Closet Arm with a horizontal pole to hang items which has a reversible drive and a method of stopping the horizontal pole when it reaches the upper or lower height limit. A preferred embodiment includes a bearing washer assembly supporting each mounted support arm axle inside each side arm bearing block.

11 Claims, 9 Drawing Sheets

MECHANICAL CLOSET

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of closet storage and more specifically to a mechanical closet arm.

Many different solutions have been tried for the problem of hanging clothes in a closet in an way which will both save space, allow easy access, and which will also be accessible to the handicapped.

U.S. Pat. No. 2,433,275 (Feb. 13, 1946, Higby) is a clothes closet hanger that uses a simple brace and manually moves up and down. It does not have the arm assembly or a motorized component which are important distinguishing features of the present invention.

U.S. Pat. No. 4,111,309 (Sep. 5, 1978, Henry) is an adjustable garment assembly using a hook and frame system which is not based on a movable arm.

U.S. Pat. No. 4,252,242 (Feb. 24, 1981, Tudor) describes a clothing rack which swings in a horizontal plane rather than vertically as the subject invention.

U.S. Pat. No. 4,485,928 (Dec. 4, 1984, Staashelm) discloses an article storage rack using a forwardly slideable box for articles.

U.S. Pat. No. 4,760,926 (Aug. 2, 1988, Iuni) is a light bulb organizer primarily for light bulbs and uses an accordion hinge arrangement to move a holder up and down rather than using a rotating arm which moves vertically.

U.S. Pat. No. 4,886,172 (Dec. 12, 1989, Kummerlen) describes a clothes hanging stand which uses a leg to support the arm in a horizontal position. The subject invention is supported by an opposing arm inside the opposite side of the cabinet.

U.S. Pat. No. 5,535,896 (Jul. 16, 1996, Morgan) is a hanging apparatus for trousers which uses rods and spacers to support a number of horizontally swinging rods whereas the subject invention also swings vertically.

U.S. Pat. No. 5,560,501 (Oct. 1, 1996, Rupert) discloses an articulatable storage organizer which has articulated arms anchored at the base to bring shelves or a clothing bar out upon demand. In the subject invention herein disclosed, the pole arm is anchored on the sides, and a scissors arrangement is not used. Instead the entire arm rotates on a motorized mounting on the inside of the closed panel.

U.S. Pat. No. 5,758,782 (Jun. 2, 1998, Rupert) describes an articulatable storage organizer which is similar to U.S. Pat. No. 5,560,501, but has a bottom shelf unlike the current application.

U.S. Pat. No. 6,065,618 (May 23, 2000, Stetler) is a closet organizing system which uses telescoping poles and ceiling brackets.

U.S. Pat. No. 6,196,398-B1 (Mar. 6, 2001, Lowe) is a hanger apparatus and method primarily for use on a door.

None of the relevant art has the distinguishing features of the subject invention which include a novel mechanical mechanism to raise and lower the bar. Also it has an arm which allows one to keep the clothes on the bar as it is swiveled out. In addition, it has a novel way of anchoring the bar to the sides of the closet and then moving the closet bar out.

BRIEF SUMMARY OF THE INVENTION

The primary object of the invention is to provide a better method of hanging clothes.

Another object of the invention is to provide a better method of hanging a larger number of clothes in a smaller area.

Another object of the invention is to provide a better method of hanging clothes in closets which are higher than can easily be reached.

A further object of the invention is to provide a better method of storing and reaching clothes for handicapped persons.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a mechanical closet arm comprising: a horizontal pole to hang items on, a left side support arm, a left side support arm axle, the left side support arm connected at one end to the left side support axle, the left side support arm connected at the other end to the left side of the horizontal pole, a left side support arm axle mounting means on the left side of a storage area, the left side support arm axle mounted inside the left side support arm axle mounting means, a right side support arm, a right side support arm axle, the right side support arm connected at one end to the right side support axle, the right side support arm connected at the other end to the right side of the horizontal pole, a right side support arm axle mounting means on the right side of a storage area, the right side support arm axle mounted inside the right side support arm axle mounting means, a left side support arm axle drive transfer means, a right side support arm axle drive transfer means, a reversible drive means, a reversible drive means connected to the left side and right side support arm axle drive transfer means, a control means for the reversible drive means, a means of stopping the horizontal pole when it reaches the upper height limit, and a means of stopping the horizontal pole when it reaches the lower height limit.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

LIST OF PARTS IN DESCRIPTION (10) Left Side Support Arm Axle Mounting Means
(11) Lubrication Point
(12) Mounting Bolt
(13) Bearing Washer Assembly
(14) Mounting Lock Washer
(15) Left side support arm axle drive transfer means (left side support arm axle drive sprocket)
(16) Stand Off Washer
(17) Arm Anchor Bolt
(18) Arm Anchor Bolt Lock Washer
(19) Inner Bearing Sleeve Washer
(20) Left Side Support Arm Axle
(21) Reserved
(22) Reserved
(23) Outer Bearing Sleeve Washer
(24) Main Drive Shaft
(25) Right Side Transfer Sprocket
(26) Right side support arm axle drive chain
(27) Outer Right Side Main Drive Shaft Bearing Block
(28) Main Drive Chain Power Sprocket
(29) Inner Main Drive Shaft Bearing Block
(30) Main Motor Drive Chain
(31) Reversible Drive Means
(32) Outside Left Side Main Drive Shaft Bearing Block
(33) Left Side Support Arm axle Drive Chain
(34) Axle Support
(35) Bearing Block Mounting Nuts
(36) Left Side Support Arm
(37) Support Arm Cap
(38) Clothes
(39) Horizontal Pole (Cross-Bar)
(40) Cross Bar Anchor Means
(41) Power Box
(42) Means of Stopping the Horizontal Pole when it reaches the lower height limit.
(43) Means of Stopping the Horizontal Pole when it reaches the upper height limit. Limit Switch Means
(44) Pressure Activated Roller Bearing
(45) Center Bearing Sleeve Washer
(46) Outer Bearing Sleeve Washer
(47) Lock Washer
(48) Center Sprocket Bearing (inside sprocket)
(49) Right Side Support Arm
(50) Right Side Support Arm Axle
(51) Right Side Support Arm Axle Mounting Means
(52) Reserved.
(53) Reserved
(54) Control Means for the Reversible Drive Means
(55) Gear Reduction System
(56) Right side support arm axle drive transfer means (a Right side support arm axle drive sprocket)
(57) Left Closet Wall
(58) Closet Upper Deck
(59) Side Arm Bearing Block Mounting Plate
(60) Rear Wall of Closet

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
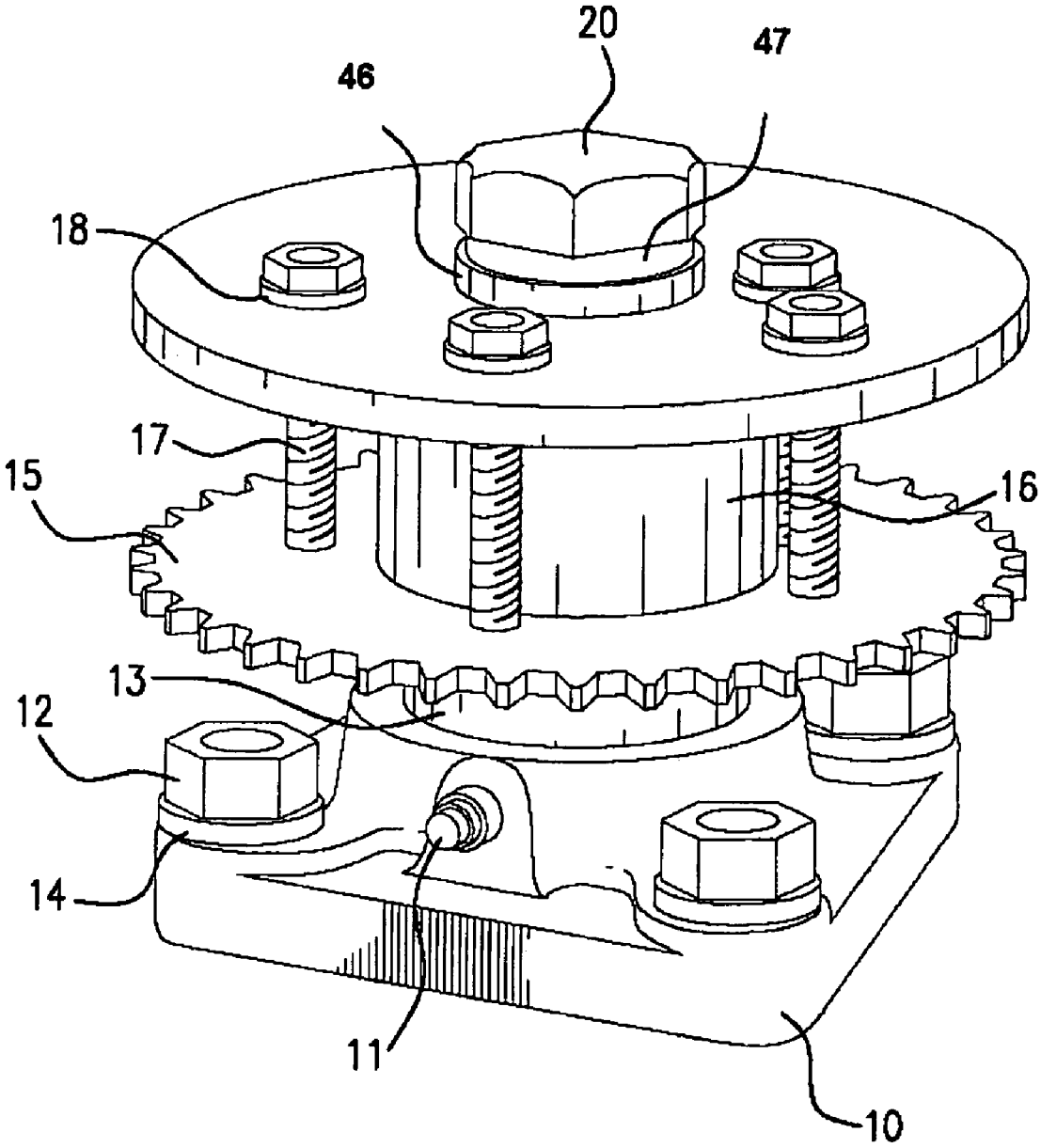
FIG. 1 is a perspective view of one of the side arm mounting assemblies of the invention.
Figure 7:
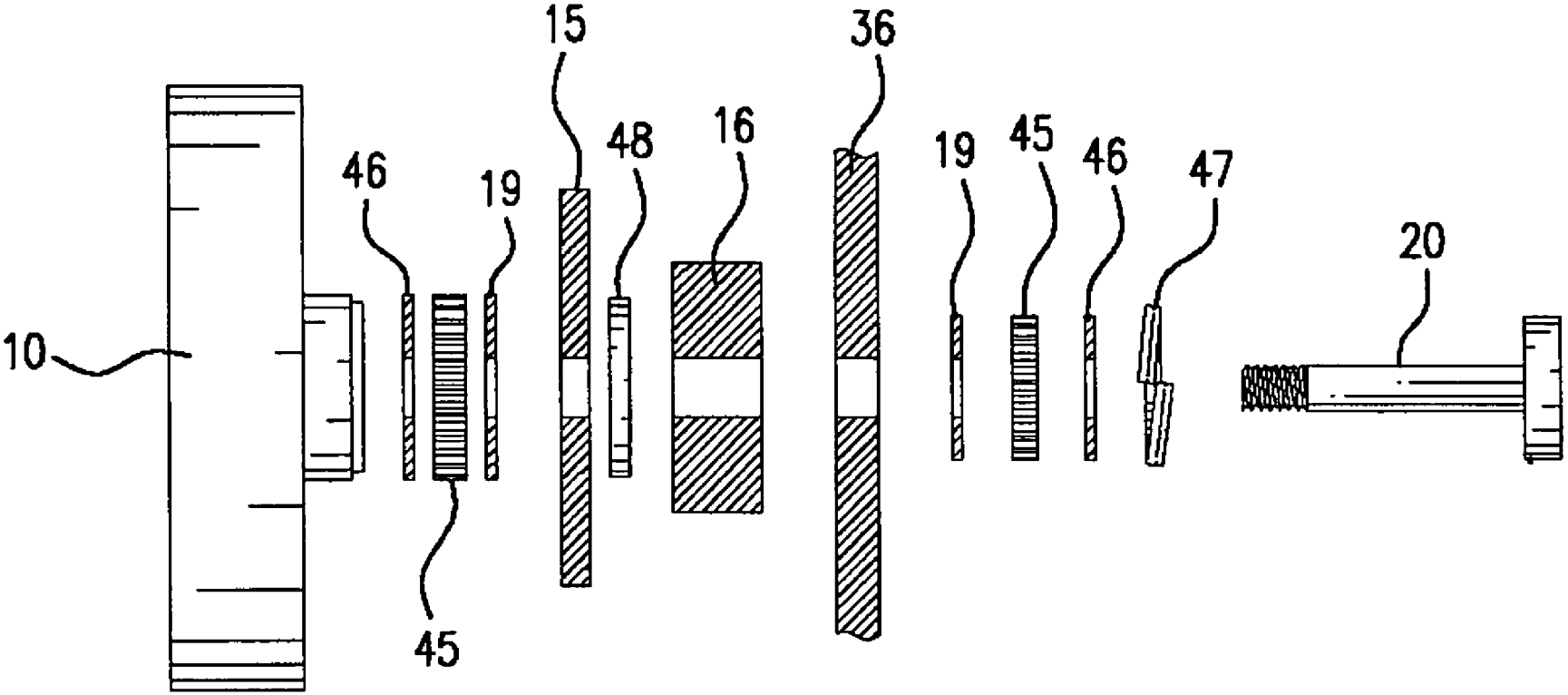
FIG. 7 is an exploded elevation view of the axle bearing washer assembly for mounting the side arms of the invention in the preferred embodiment looking at the Left Side Support Arm Axle assembly from in front of it.
Figure 9:
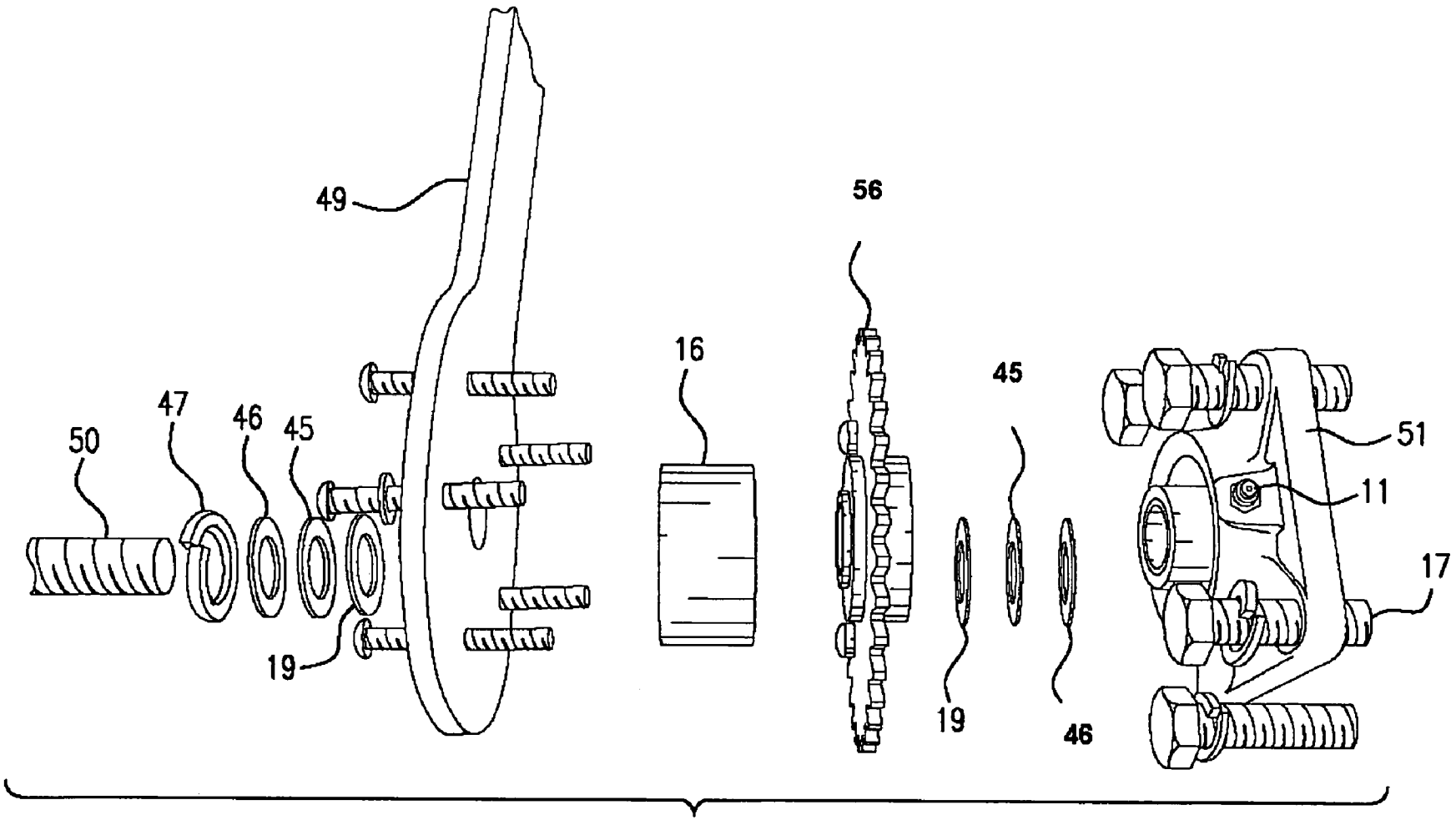
FIG. 9 is an exploded perspective schematic view of the axle bearing washer assembly for mounting the side arms of the invention in the preferred embodiment looking at the Right Side Support Arm Axle assembly from the front.

Turning first to FIG. 1 there is shown a perspective view of one of the side arm mounting assemblies of the invention (The left side). This is a view of the preferred embodiment of a Left Support Arm Assembly showing the Left Side Support Arm Axle Mounting Means (10) which in the preferred embodiment is a Bearing Block, a Lubrication Point (11) which in the preferred embodiment is a Zert fitting, the Mounting Bolts (12), the partially hidden Bearing Washer Assembly (13) which is more particularly described in FIGS. 7 and 9. Also can be seen the Mounting Lock Washers (14) used to keep the Mounting Bolts (12) from loosening in use, the Left side support arm axle drive transfer means (15) which in the preferred embodiment is a left side support arm axle drive sprocket, the Stand Off Washer (16) which in the preferred embodiment is a cut piece of Hollow Pipe, and the Arm Anchor Bolts (17) which anchor the left side and right side support arms to the side of a Closet Wall. In the preferred embodiment the Arm Anchor Bolts (17) use Arm Anchor Bolt Lock Washers (18) to prevent loosening with use as does the Left Side Support Arm Axle (20) which in the preferred embodiment is a bolt. The axle Lock Washer (47) is shown installed on the Left Side Support Arm Axle (20) next to the Outer Bearing Sleeve Washer (46). In the preferred embodiment a Center Bearing Sleeve Washer (45) is sandwiched between the Inner Bearing Sleeve Washer (19) and the Outer Bearing Sleeve Washer (46) as depicted in FIGS. 7 and 9. The right side closet arm mounting assembly is just a mirror image of FIG. 1.

Figure 2:
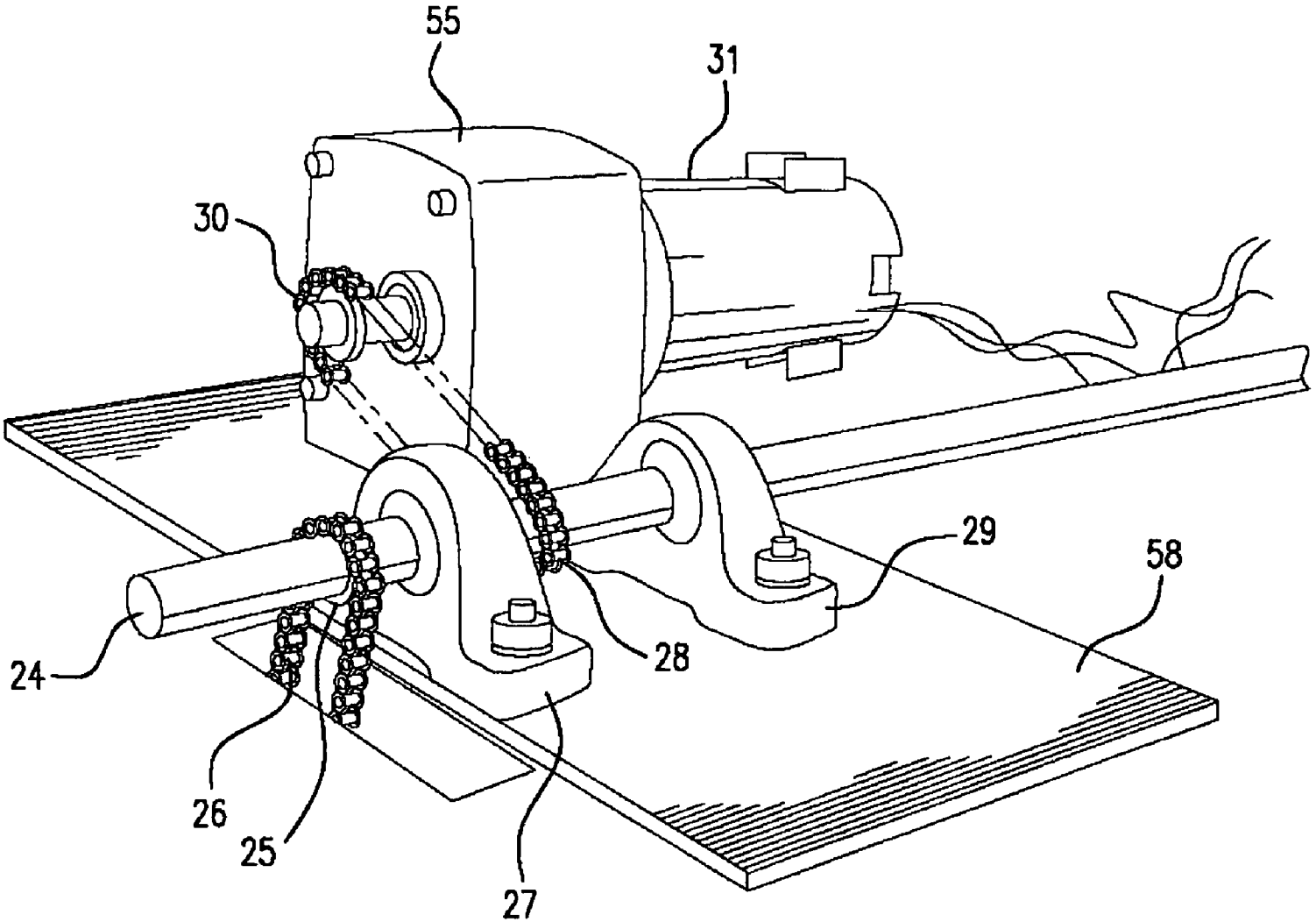
FIG. 2 is a perspective view of a preferred embodiment of the reversible drive system for the invention as seen by an observer standing behind the closet looking down on the Closet Upper Deck looking to the observer's left.

FIG. 2 is a perspective view of a preferred embodiment of the reversible drive system for the invention as seen by an observer standing behind the closet looking down on the Closet Upper Deck (58) to the observer's left. All references to "left side" or "right side" of the closet refer to the left or right side of an observer standing in front of the closet opening facing the clothes hung in the closet. The Main Drive Shaft (24) is the main power train coordinating mechanism in the preferred embodiment. In the preferred embodiment it is a ¾ inch keyed shaft. The Right Side Transfer Sprocket (25) which in the preferred embodiment is attached with a set screw and key stock to anchor it can be seen from one looking down on the Closet Upper Deck (58). Also can be seen the Right Side Support Arm Axle Drive Chain (26), the Outer Right Side Main Drive Shaft Bearing Block (27), the general area of the Main Drive Chain Power Sprocket (28), the Inner Main Drive Shaft Bearing Block (29), and the Main Motor Drive Chain (30). In the preferred embodiment the Reversible Drive Means (31) is a Reversible DC Motor with a gear reduction system (55).

Figure 3:
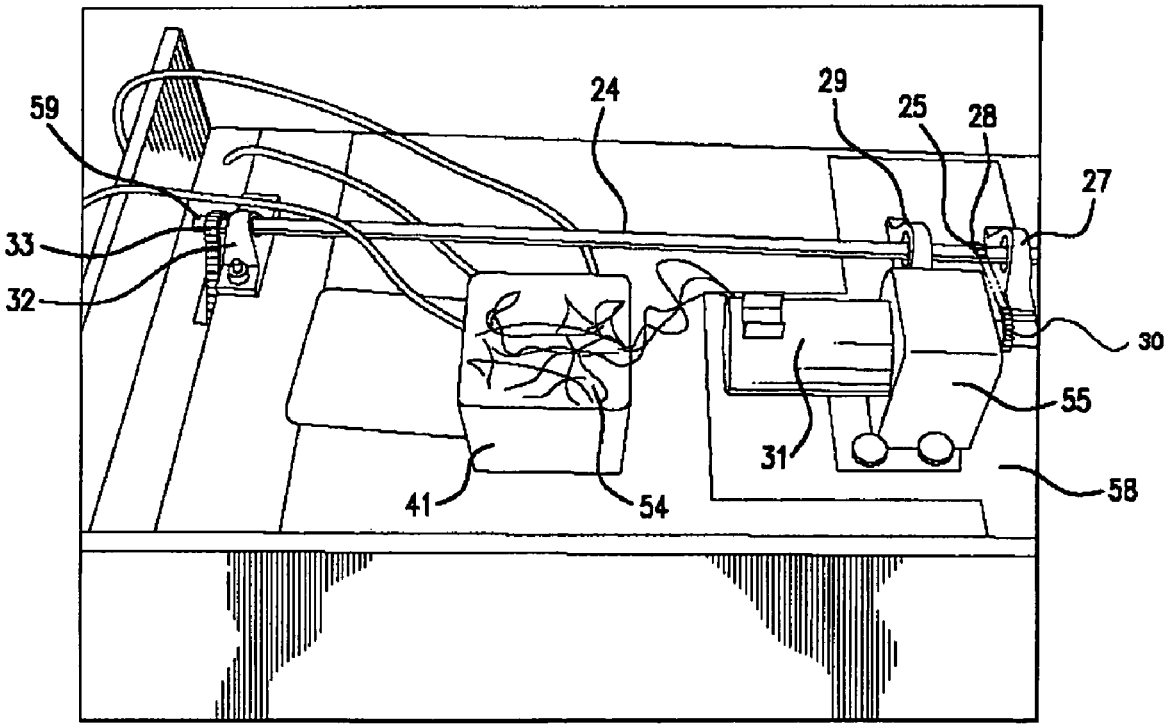
FIG. 3 is a perspective view of a preferred embodiment of the reversible drive system for the invention looking from above and behind it.

FIG. 3 is a perspective view of a preferred embodiment of the reversible drive system for the invention looking from above and in front of the Closet down onto the Closet Upper Deck (58). The Outside Left Side Main Drive Shaft Bearing Block (32) and the Left Side Support Arm Axle Drive Chain (33) are clearly visible, as are the Right Side Transfer Sprocket (25). The Outer Right Side Main Drive Shaft Bearing Block (27), the Main Drive Chain Power Sprocket (28), the Inner Main Drive Shaft Bearing Block (29), the Main Motor Drive Chain (30) and the Reversible Drive Means (31) along with the Gear Reduction System (55) are also visible. The Power Box-Control Box (41) is also visible. In the preferred embodiment this provides stepped down DC current and the Control Means (54) for the Reversible Drive Means (31) to operate the invention.

Figure 4:
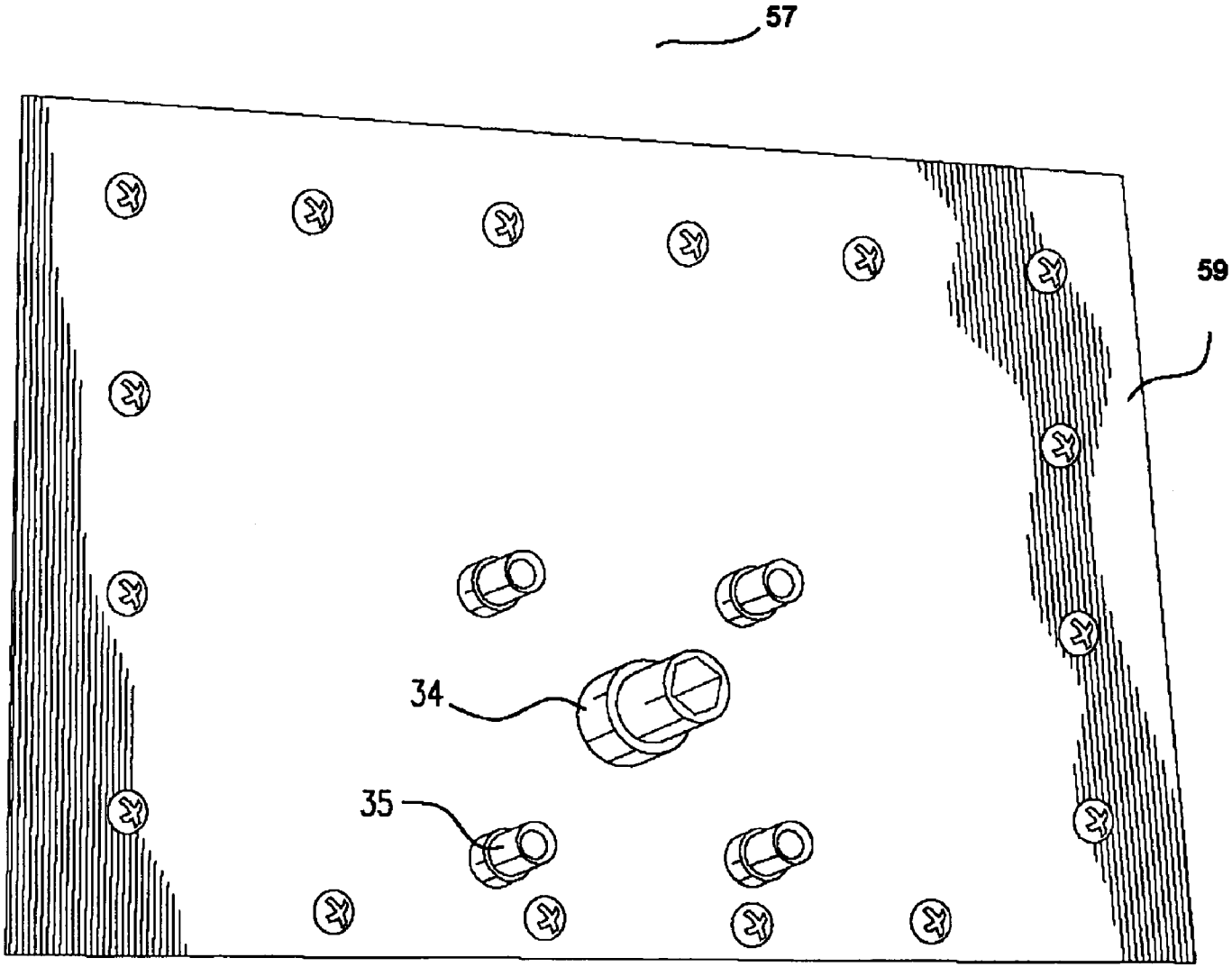
FIG. 4 is a perspective view of the anchor system for the side arm mounting assemblies of the invention.

FIG. 4 is a perspective view of the anchor system for the side arm mounting assemblies of the invention. The Axle Supports (34) and the Bearing Block Mounting Nuts (35) along with the Side Arm Bearing Block Mounting Plate (59) are visible on the outside of the Left Closet Wall (57).

Figure 5:
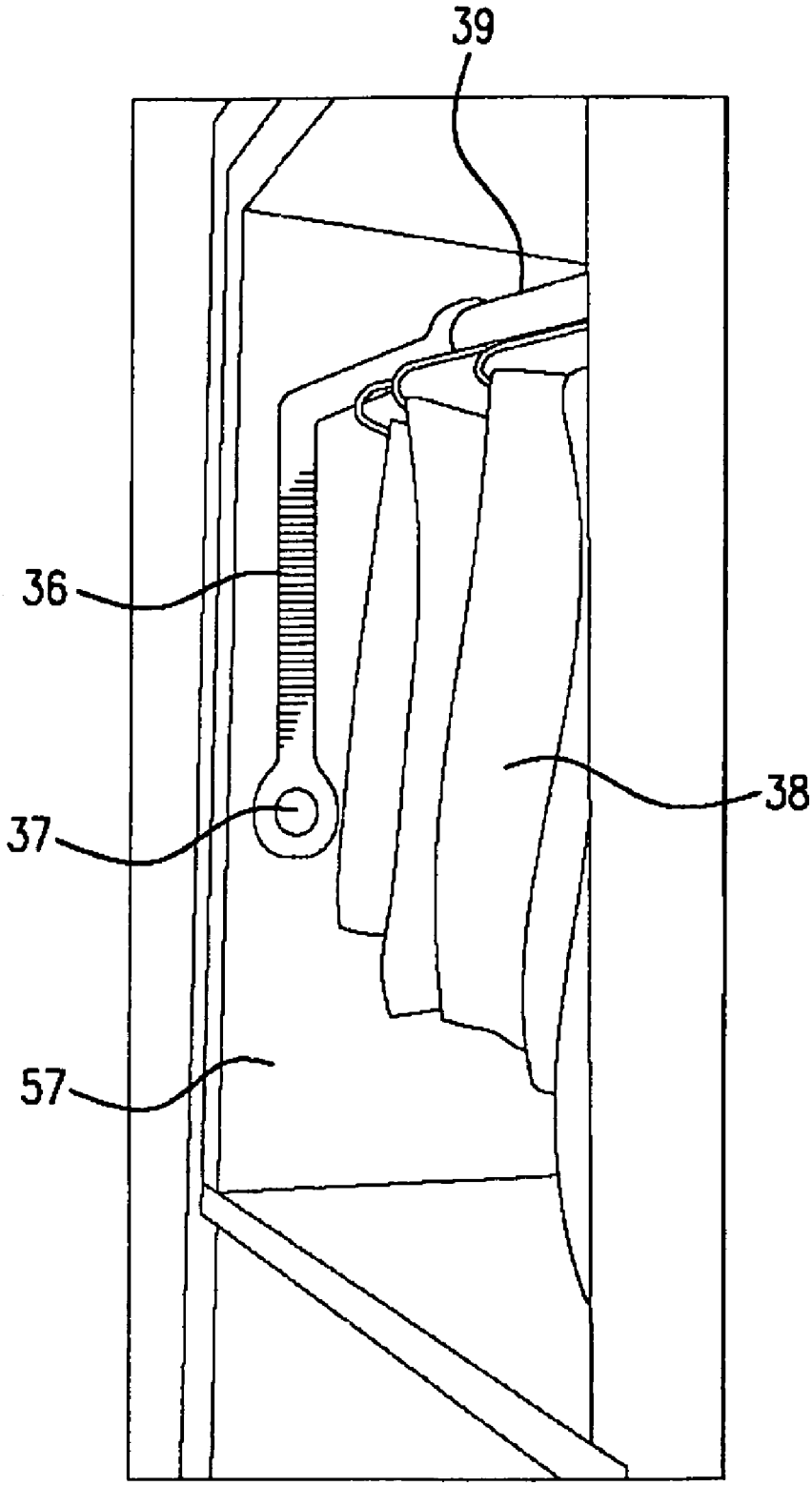
FIG. 5 is a perspective view of the invention with the clothes in an upright position for an observer standing in front of the closet on the right side of the closet looking to the left.

FIG. 5 is a perspective view of the invention with the clothes in an upright position for an observer standing in front of the closet on the right side of the closet looking towards the left side closet wall (57). The Left Side Support Arm (36), the Support Arm Cap (37) and the Clothes (38) are visible when the Horizontal Pole (39) has been raised to the full Upper Position (Retracted Position). In the preferred embodiment, the Support Arm Cap (37) is anchored by a plurality of strong magnets which bind it to the support arm.

Figure 6:
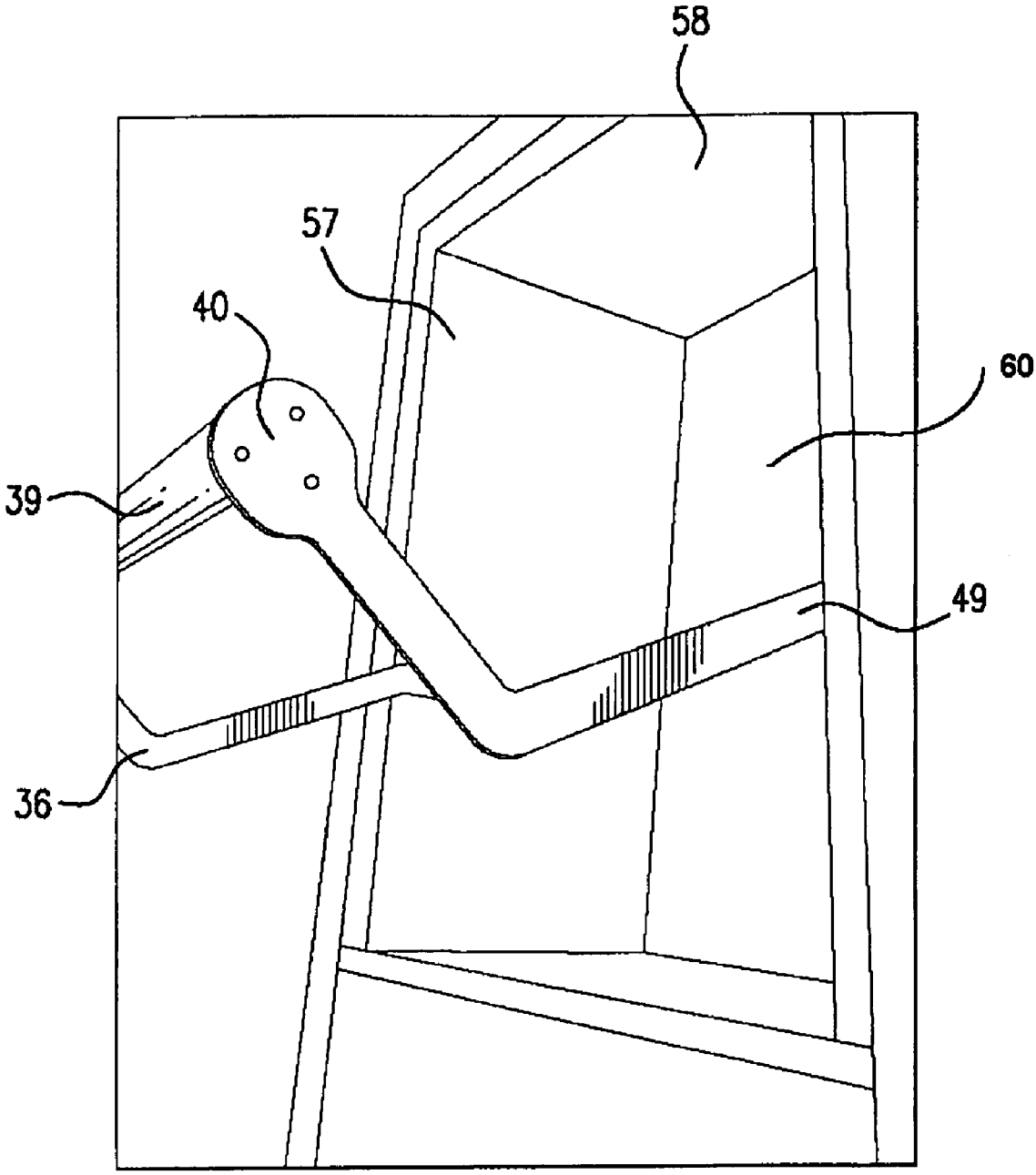
FIG. 6 is a perspective view of the invention with the clothes off the horizontal pole in an open position for an observer on the right looking to the left.

FIG. 6 is a perspective view of the invention with the clothes removed from the Horizontal Pole (39) or "Cross-Bar" in an open position for an observer in front of the closet on the right side looking to the left. The Left Side Support Arm (36) and the Right Side Support Arm (49) can be seen. The Horizontal Pole (39) or Cross-Bar is anchored to the Left Side Support Arm (36) by any Cross-Bar Anchor Means (40), such as bolts, welding, screws etc. The inner top of the closet (58) and the rear wall of the closet (60) can also be seen.

FIG. 7 is an exploded elevation view of the axle bearing washer assembly for mounting the side arms of the invention in the preferred embodiment looking at the Left Side Support Arm Axle assembly from in front of it. Described from left to right are the Left Side Support Arm Axle Mounting Means (10), the Outer Bearing Sleeve Washer (46), the Center Bearing Sleeve Washer (45), an Inner Bearing Sleeve Washer (19), the Left Side Support Arm Axle Drive Transfer Means (15) which in the preferred embodiment is a support arm axle drive sprocket, the Center Sprocket Bearing (48) which is inside the sprocket (15), the Stand Off Washer (16), the Left Side Support Arm (36), the Inner Bearing Sleeve Washer (19), the Center Bearing Sleeve Washer (45), the Outer Bearing Sleeve Washer (46), a Lock Washer (47), and the Left Side Support Arm Axle (20) which in the preferred embodiment is a bolt. An identical mirror image of this assembly (Shown in FIG. 9) is used on the right side of the Closet for the Right Side Support Arm Axle (50) and the Right Side Support Arm Axle Mounting Means (51).

Figure 8:
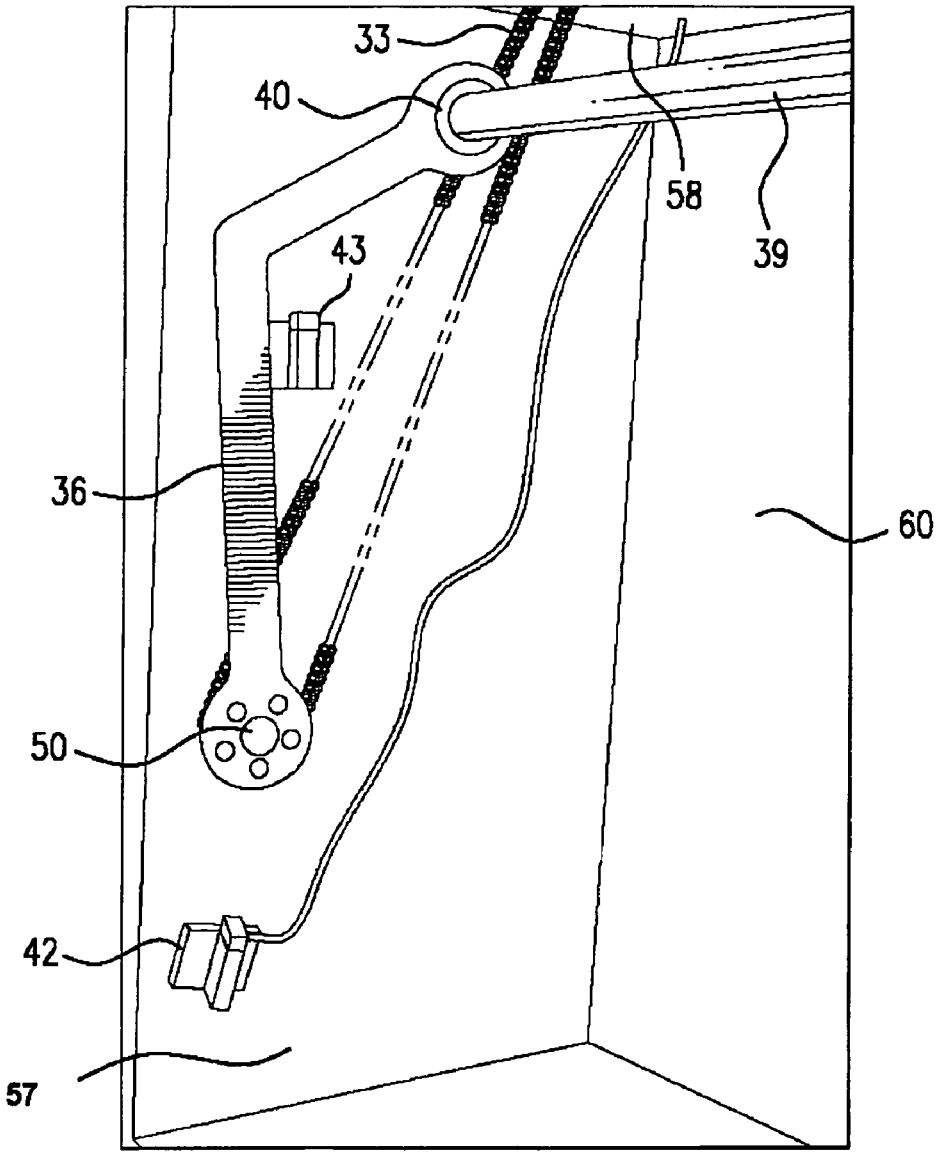
FIG. 8 is a perspective view of the invention showing the limit switch means in the preferred embodiment for stopping the side arms in the appropriate positions.

FIG. 8 is a perspective view of the invention showing the limit switch means in the preferred embodiment for stopping the side arms in the appropriate positions as seen by an observer standing in front of the closet looking towards its left side. The Means of Stopping the Horizontal Pole (39) when it reaches the lower height limit in the preferred embodiment is by the use of a Lowered Arm Position Stop Limit Switch Means (42) which is comprised of a stop limit switch having a pressure activated roller bearing which activates a rocker switch when it makes contact with the Left or Right Side Support Arm (36) or (49). Similarly, the Means of Stopping the Horizontal Pole when it reaches the upper height limit or Raised Arm Position Stop Limit Switch Means (43) is also a stop limit switch having a pressure activated roller bearing which activates a rocker switch when it makes contact with the Left or Right Side Support Arm (36) or (49). In another embodiment, the stop limit switch can also be activated by an internal pivot arm attached to the Left or Right Side Support arm Axle Drive Transfer Means (15) or (56). The internal pivot arm in such an embodiment is concealed behind the side of the inner Left closet wall (57). The Left Side Support Arm Axle Drive Chain (33) is also visible.

Figure 8A:
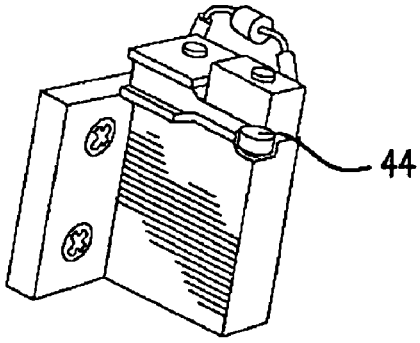
FIG. 8*a* is a perspective view of the invention showing a close up of the limit switch means used in the preferred embodiment for stopping the side arms in the appropriate positions.

FIG. 8A is a perspective view of the invention showing a close up of the limit switch means used in the preferred embodiment for stopping the side arms in the appropriate positions. In the preferred embodiment it is a Limit Switch Means comprised of a Pressure Activated Roller Bearing (44).

FIG. 9 is an exploded perspective view of the axle bearing washer assembly for mounting the side arms of the invention in the preferred embodiment looking at the Right Side Support Arm Axle assembly from the front. Described from right moving to the left are the Right Side Support Arm Axle Mounting Means (51), an Outer Bearing Sleeve Washer (46), a Center Bearing Sleeve Washer (45), an Inner Bearing Sleeve Washer (19), the Right side support arm axle drive transfer means (56) which in the preferred embodiment is a Right side support arm axle drive sprocket (the Center Sprocket Bearing (48) which is inside the sprocket of the Right side support arm axle drive transfer means (56) is not shown). Continuing from right to left, the Stand Off Washer (16), the Right Side Support Arm (49), the Inner Bearing Sleeve Washer (19), the Center Bearing Sleeve Washer (45), the Outer Bearing Sleeve Washer (46), the Lock Washer (47) and the Right Side Support Arm Axle (50) which in the preferred embodiment is a bolt are represented. An identical mirror image of this assembly (See FIG. 7) is used on the left side of the Closet for the Left Side Support Arm assembly.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Mechanical Closet Arm comprising:

a horizontal pole to hang items on;

a left side support arm;

a left side support arm axle;

the left side support arm connected at one end to the left side support arm axle;

the left side support arm connected at the other end to the left side of the horizontal pole;

a left side support arm axle mounting means on the left side of a storage area;

the left side support arm axle mounted inside the left side support arm axle mounting means;

a right side support arm;

a right side support arm axle;

the right side support arm connected at one end to the right side support arm axle;

the right side support arm connected at the other end to the right side of the horizontal pole;

a right side support arm axle mounting means on the right side of a storage area;

the right side support arm axle mounted inside the right side support arm axle mounting means;

a left side support arm axle drive transfer means;

a right side support arm axle drive transfer means;

a reversible drive means comprised of an outer left side main drive shaft bearing block, an inner main drive shaft bearing block, a right side main drive shaft bearing block, a main drive shaft, the main drive shaft mounted between the outer left side and outer right side main drive shaft bearing blocks, a left side support arm axle drive sprocket, the left side support arm axle drive sprocket attached to the left side of the main drive shaft mounted on the main drive shaft bearing block, a left side support arm axle drive chain, a right side support arm drive chain, the right side support arm axle drive chain connected to the right side support arm axle drive transfer means, a main drive chain power sprocket, the main drive chain power sprocket mounted on the main drive shaft between the left side and right side main drive shaft bearing blocks, a main motor drive chain, an outer right side main drive shaft bearing block, a right side drive chain sprocket mounted on the right side of the main drive shaft, and a right side support arm axle drive chain connected to the right side support arm axle drive transfer means;

a reversible drive means connected to the left side and right side support arm axle drive transfer means;

a control means for the reversible drive means;

a means of stopping the horizontal pole when the horizontal pole reaches the upper height limit; and a means of stopping the horizontal pole when the horizontal pole reaches the lower height limit.

2. The Mechanical Closet Arm as claimed in claim 1 wherein the main drive shaft is comprised of a ¾" keyed drive shaft.

3. The Mechanical Closet Arm as claimed in claim 1 wherein each support arm axle is comprised of a bearing washer assembly supporting each mounted support arm axle inside each side arm bearing block, said bearing washer assembly being comprised as follows viewed from the side arm bearing block on the side of the closet wall towards the inside of the closet: an outer bearing sleeve washer, a center bearing sleeve washer, an inner bearing sleeve washer, a side support arm axle drive transfer means comprised of a center sprocket bearing inside a side support arm axle drive sprocket, a stand off washer, a support arm, another inner bearing sleeve washer, another center bearing sleeve washer, and another outer bearing sleeve washer, next to a lock washer which is next to the end of the axle head.

4. The Mechanical Closet Arm as claimed in claim 3 wherein a stand off washer is placed between the drive means and each left and right arm side support arm axle mounting means.

5. The Mechanical Closet Arm as claimed in claim 4 wherein the stand off washer is a piece of hollow pipe.

6. The Mechanical Closet Arm as claimed in claim 1 wherein the power for the reversible drive means is provided by a DC motor.

7. The Mechanical Closet Arm as claimed in claim 1 wherein the means of stopping the horizontal pole when the horizontal pole reaches the lower and higher height limits is a stop limit switch means.

8. The Mechanical Closet Arm as claimed in claim 7 wherein the stop limit switch is comprised of a pressure activated roller bearing which activates a rocker switch means when the pressure activated roller bearing makes contact with one of the support arms.

9. The Mechanical Closet Arm as claimed in claim 7 wherein the stop limit switch is activated by a hidden internal pivot arm attached to the left or right side support arm axle drive transfer means.

10. The Mechanical Closet Arm as claimed in claim 1 wherein each side support arm axle has a support arm cap which conceals one end of the arm axle.

11. The Mechanical Closet Arm as claimed in claim 10 wherein each side support arm cap is anchored by a plurality of strong magnets which bind the side support arm cap to the support arm.

* * * * *